US008123426B2

(12) United States Patent
Byun

(10) Patent No.: US 8,123,426 B2
(45) Date of Patent: Feb. 28, 2012

(54) TUBE-SHAPED COSMETIC CONTAINER FOR DISCHARGING CREAM-TYPE COSMETICS

(76) Inventor: Young-Kwang Byun, Seoul (KR)

( * ) Notice: Subject to any disclaimer, the term of this patent is extended or adjusted under 35 U.S.C. 154(b) by 1016 days.

(21) Appl. No.: 11/524,373

(22) Filed: Sep. 21, 2006

(65) Prior Publication Data

US 2007/0217860 A1 Sep. 20, 2007

(30) Foreign Application Priority Data

Mar. 14, 2006 (KR) ..... 10-2006-0023509

(51) Int. Cl.
*A47L 13/22* (2006.01)
*B43K 5/00* (2006.01)

(52) U.S. Cl. ..... 401/278; 401/202; 401/205; 401/206; 401/269

(58) Field of Classification Search ..... 401/5, 102, 401/202, 205, 206, 269, 272, 278
See application file for complete search history.

(56) References Cited

U.S. PATENT DOCUMENTS

| | | | | |
|---|---|---|---|---|
| 2,847,692 | A * | 8/1958 | Edelstone et al. | 401/102 |
| 3,545,874 | A * | 12/1970 | Schwartzman | 401/186 |
| 3,655,290 | A * | 4/1972 | Griffith | 401/186 |
| 5,904,433 | A * | 5/1999 | Kay | 401/269 |
| 7,563,048 | B2 * | 7/2009 | Koptis | 401/202 |
| 2005/0184095 | A1 * | 8/2005 | Lee et al. | 222/181.1 |

* cited by examiner

*Primary Examiner* — David Walczak
(74) *Attorney, Agent, or Firm* — Birch, Stewart, Kolasch & Birch, LLP

(57) ABSTRACT

A tube-shaped cosmetics container for discharging cream-type cosmetics, and more particularly, to a tube-shaped container containing cream-type cosmetics, an intermediate member, and a cap. When the cap is opened, the discharger is opened, and when closed, the discharger is sealed, which makes the discharge of cream-type cosmetics easy. And when not in use, an intermediate member is pressed by being thread coupled, thereby the discharger is naturally sealed so that the discharge of cream-type cosmetics contained in the tube-shaped container is prevented, by which cream-type cosmetics is less wasted, and a clean state is always kept by preventing contamination of surrounding areas of the cosmetic container.

18 Claims, 15 Drawing Sheets

TUBE-SHAPED COSMETIC CONTAINER FOR DISCHARGING CREAM-TYPE COSMETICS

CROSS-REFERENCE TO RELATED APPLICATIONS

This application claims the benefit of Korean Patent Application No. 10-2006-0023509, filed on Mar. 14, 2006, in the Korean Intellectual Property Office, the disclosure of which is incorporated herein by reference.

BACKGROUND

1. Field of the Invention

The present invention relates to a tube-shaped cosmetics container for discharging cream-type cosmetics, and more particularly, to a tube-shaped container containing cream-type cosmetics, an intermediate member 20, and a cap 30. As the cap 30 is opened, a pressing step wheel 31, formed inside the cap 30, which is pressing a pressing step 21*a* forming a circumference portion of a pressing board 21 of the intermediate member 20, is separated, thereby as a force being applied to the pressing board 21 is released, a conical elastic portion 26 is sprung, the pressing board 21, in which a sponge-shaped cap 23 is covered and fixed, rises. And as a discharger, which was closed by touching a upper part of the vertical rod 16, 24 is separated from the upper part of a vertical rod 16, the discharger 24 is opened. And as thread coupled by covering the cap 30, an inner thread portion 32 is thread coupled to an outer thread portion 14 of a upper moving body, thereby the pressing step wheel 31, formed inside the cap, presses the pressing step 21*a*, the circumference portion 21*a* of the pressing board 21, formed in the intermediate member 20, so the pressing board 21 is pressed, thereby the conical elastic portion 26 drops by compression, and the discharger 24, formed to the center of the intermediate member 20, is automatically sealed as the discharger 24 comes into contact with the upper part of the vertical rod. Therefore, when the cap is opened, the discharger is opened, and when closed, the discharger is sealed, which makes the discharge of cream-type cosmetics easy. And when not in use, an intermediate member is pressed by being thread coupled, thereby the discharger is naturally sealed so that the discharge of cream-type cosmetics contained in the tube-shaped container is prevented, by which cream-type cosmetics is less wasted, and a clean state is always kept by preventing contamination of surrounding areas of the cosmetic container 1.

2. Discussion of Related Art

Generally, a cosmetics container containing cream-type cosmetics according to a conventional art comprises, as illustrated in FIG. 14 and FIG. 15, container body 110, a discharger 111 having a discharge hole 112 discharging cream-type cosmetics contained in the containing body 110, and a cap 120 which is thread coupled or insertion coupled.

The cosmetics container 100 according to a conventional art consisting of the above components discharges an appropriate amount of cream-type cosmetics inside the container body 110 to a palm of a user so that the cosmetics can be applied to a face or other areas.

However, since the user's palms are stained with cosmetics after using a conventional cosmetics container 110, the user should wash his or her hands later, and cosmetics applied to palms are also washed when washing the user's hands so that expensive cosmetics are wasted unnecessarily.

SUMMARY OF THE INVENTION

In order to solve the above-described problems, it is an objective of the present invention to provide a cosmetics container for discharging cream-type cosmetics capable of regulating the discharge of cream-type cosmetics contained in a tube-shaped container by opening/closing a discharger formed to the central portion by a pumping of a conical elastic portion forming an intermediate member as opening and closing a cap which is thread coupled to the upper part of a tube-shaped container, making the discharge of cream-type cosmetics easy by opening the discharger when the cap is opened and by sealing the discharger when not in use, and preventing the discharge of cream-type cosmetics contained in the tube-shaped container as an intermediate member is pressed, thereby a discharge is naturally sealed when not in use, so that a waste of cream-type cosmetics is reduced, and a contamination of a cosmetics container and surrounding areas is prevented, thereby a clean state is always kept.

BRIEF DESCRIPTION OF THE DRAWINGS

These and/or other objects and advantages of the invention will become apparent and more readily appreciated from the following description of preferred embodiments, taken in conjunction with the accompanying drawings of which.

DETAILED DESCRIPTION OF PREFERRED EMBODIMENTS

Hereinafter, preferred embodiments of the present invention will be described with reference to the accompanying drawings.

Figure 1:
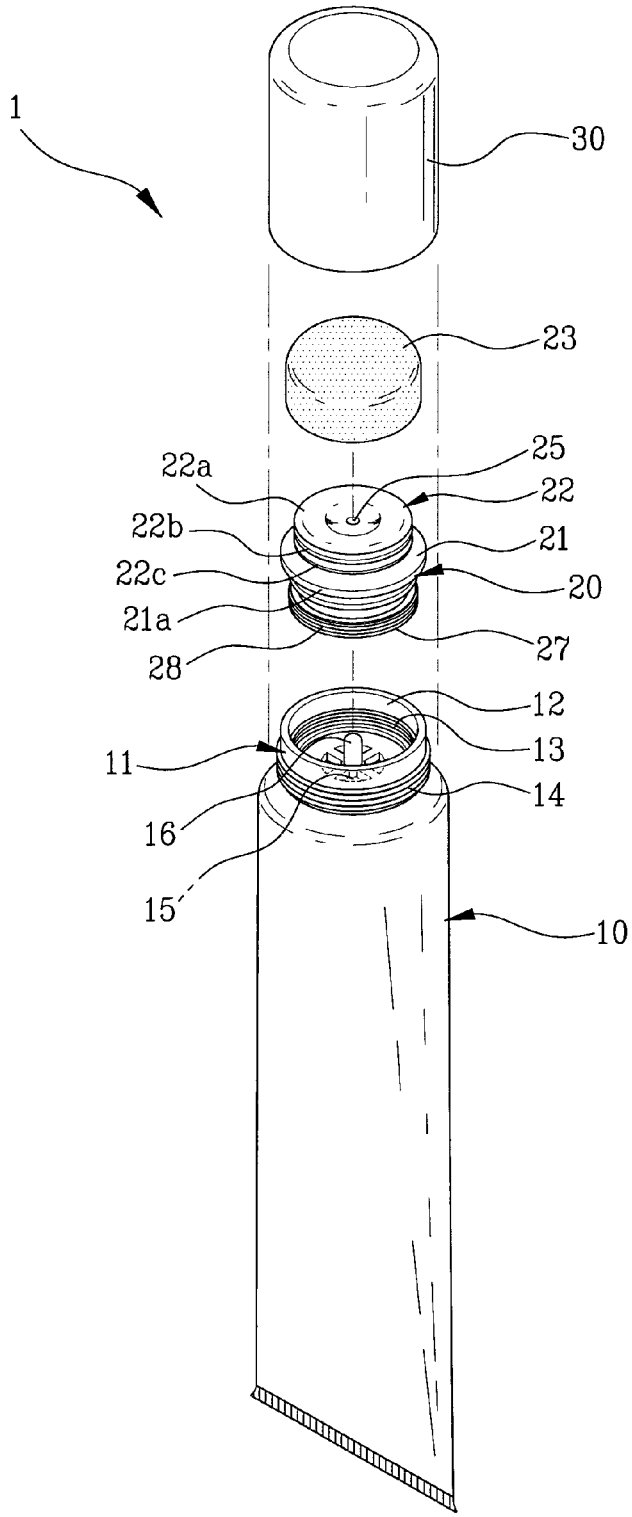
FIG. 1 is an exploded perspective view of a first embodiment of the present invention.
Figure 2:
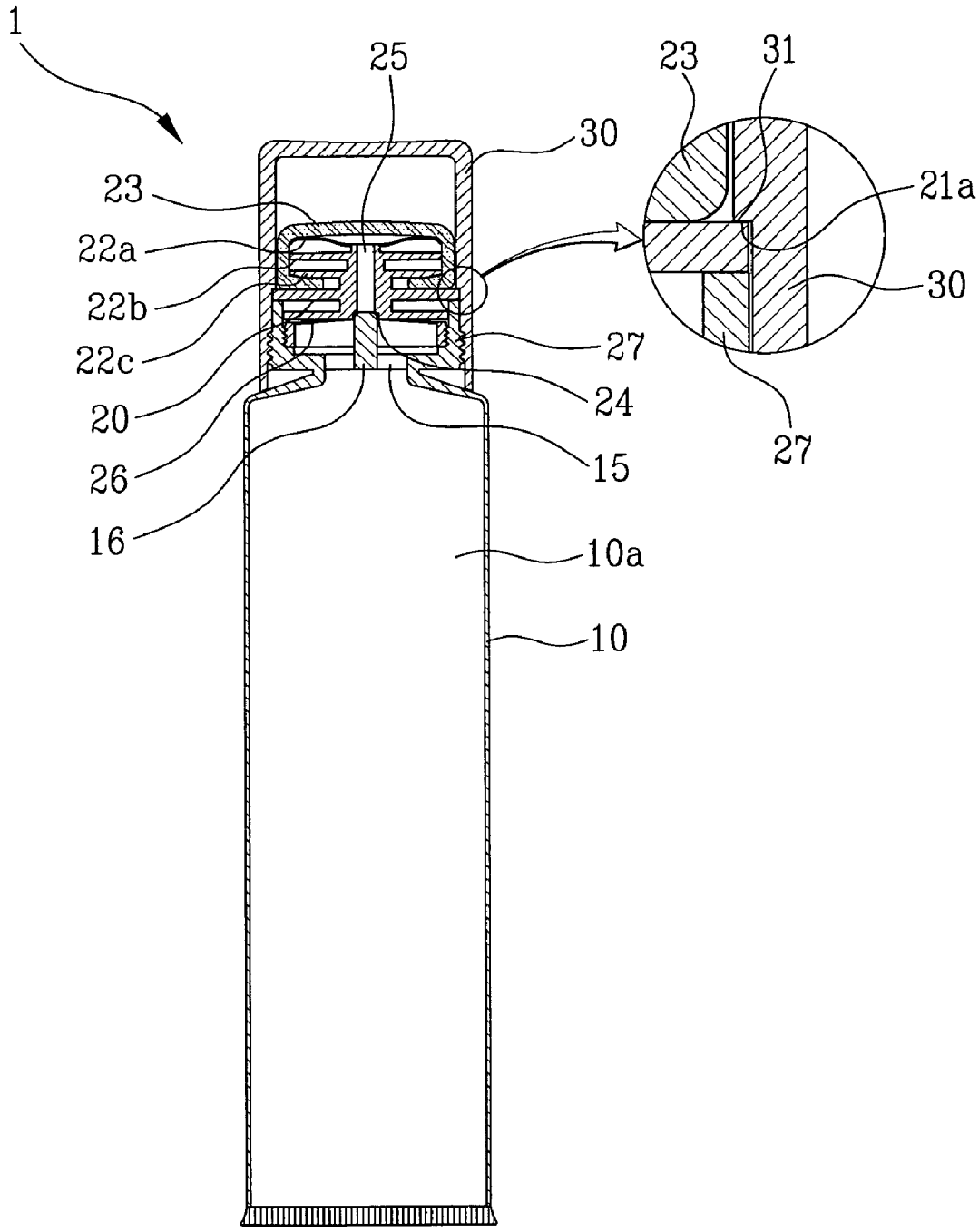
FIG. 2 is a sectional view of a first embodiment of the present invention.
Figure 3:
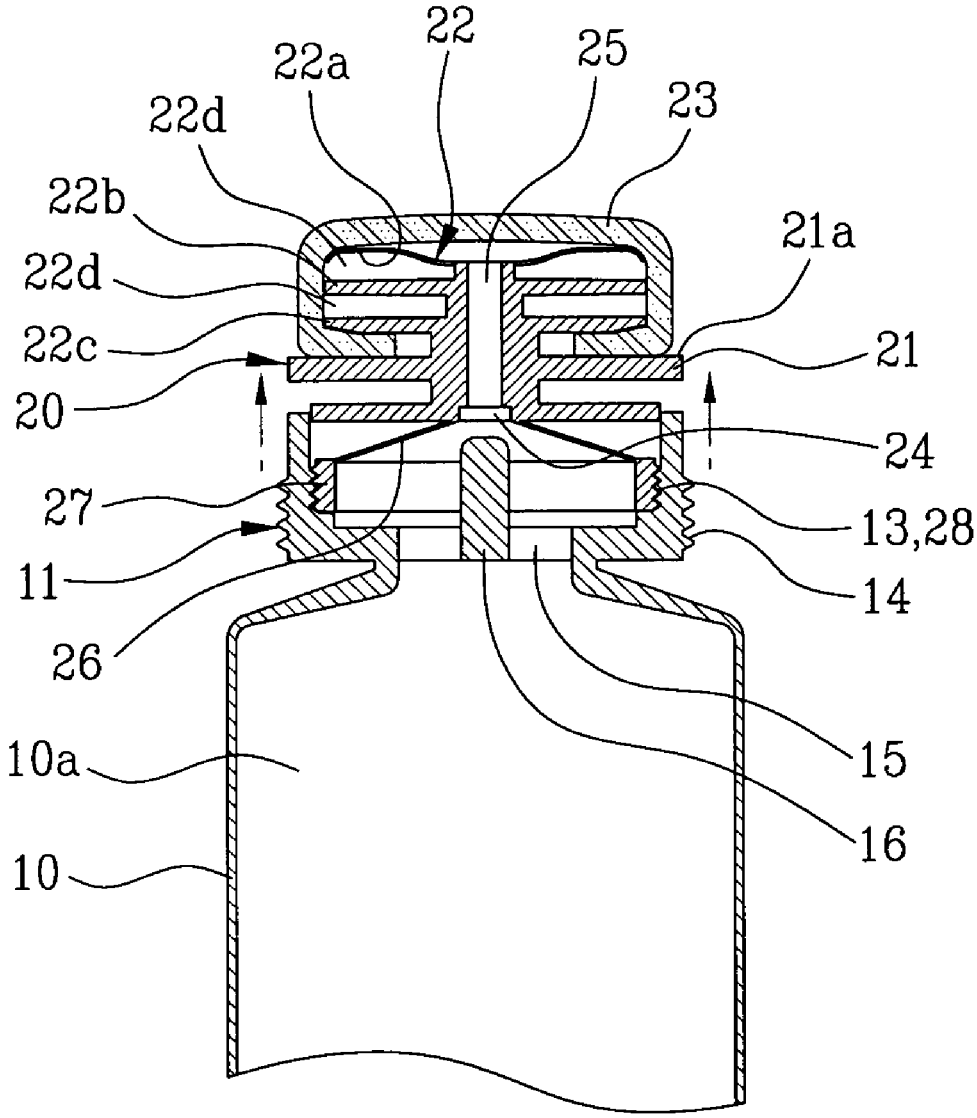
FIG. 3 is an extended sectional view illustrating a principal part of which cap is opened according to a first embodiment of the present invention.

FIG. 1 is an exploded perspective view of a first embodiment of the present invention, FIG. 2 is a sectional view of a first embodiment of the present invention, and FIG. 3 is an extended sectional view illustrating a principal part of which cap is opened according to a first embodiment of the present invention.

A tube-shaped cosmetics container 1 according to the present invention comprises a tube-shaped container 10 containing cosmetics, an intermediate member 20 transferring and discharging cosmetics, and a cap 30.

As the cap 30 is opened, a pressing step wheel 31, formed inside the cap 30, which is pressing a pressing step 21*a* forming a circumference portion of a pressing board 21 of the intermediate member 20, is separated, thereby as a force being applied to the pressing board 21 is released, a conical elastic portion 26 is sprung, the pressing board 21, in which a sponge-shaped cap 23 is covered and fixed, rises. And as a discharger, which was closed by touching a upper part of the vertical rod 16, 24 is separated from the upper part of a vertical rod 16, the discharger 24 is opened. And as thread coupled by covering the cap 30, an inner thread portion 32 is thread coupled to an outer thread portion 14 of a upper moving body, thereby the pressing step wheel 31, formed inside the cap, presses the pressing step 21*a*, the circumference portion 21*a* of the pressing board 21, formed in the intermediate member 20, so the pressing board 21 is pressed, thereby the conical elastic portion 26 drops by compression, and the discharger 24, formed to the center of the intermediate member 20, is automatically sealed as the discharger 24 comes into contact with the upper part of the vertical rod. Therefore, when the cap is opened, the discharger is opened, and when closed, the discharger is sealed, which makes the discharge of cream-type cosmetics easy. And when not in use, an intermediate member is pressed by being thread coupled, thereby the discharger is naturally sealed so that the discharge of cream-type cosmetics contained in the tube-shaped container is prevented.

Hereinafter, the present invention will be described in detail with reference to the attached drawings.

As illustrated in FIG. 1 through FIG. 3, a tube-type container 10 constituting a cosmetics container 1 according to the present invention includes an upper moving body in which an opening portion 12 is formed to an upper direction, an inner thread portion 13 to an inner side, and an outer thread portion 14 to an outer circumference portion.

Also, an penetrating hole 15 is formed to an inner center of the upper moving body 11 formed like the above, and a vertical rod 16, which plays a role of opening/closing, is formed at the same time.

An intermediate member 20 is placed to the inside of an opening portion 12 of the upper moving body 11 formed to the upper part of the tube-shaped container 10. Also, a cap holder part 22 is formed to the upper part in the intermediate member 20, thereby a sponge-type cap 23 is covered and formed to the circumference, and a transporting tube 25 having a discharger 24 in a center is vertically formed, thereby a pressing board 21, in which a pressing step 21*a* is formed to the outer circumference, is formed.

Also, a coupling member 27, in which an outer thread part 28 is formed to the outside by a conical elastic part 26 to a lower side of the discharger, is provided and formed.

A coupling member 27, which is formed to the lower side, is placed to the inner side of an opening part, formed to the upper side of the upper moving body 11, thereby an outer thread part 28, formed to an outer circumference of the coupling member 27 of the opening part 12, is thread coupled with an intermediate member 20 in which an inner thread part 13, formed to an inner circumference of the opening part 12.

A cap 30 is coupled to an upper side of a sponge cap 23 covered to the upper side of the thread-coupled intermediate member 20, and an inner thread pat 32, formed to the inner lower side of the cap 30 is thread coupled to an outer thread part 14 of the upper moving body 11, which constitutes a tube-shaped cosmetics container 1 for discharging cream-type cosmetics of the present invention.

Figure 4:
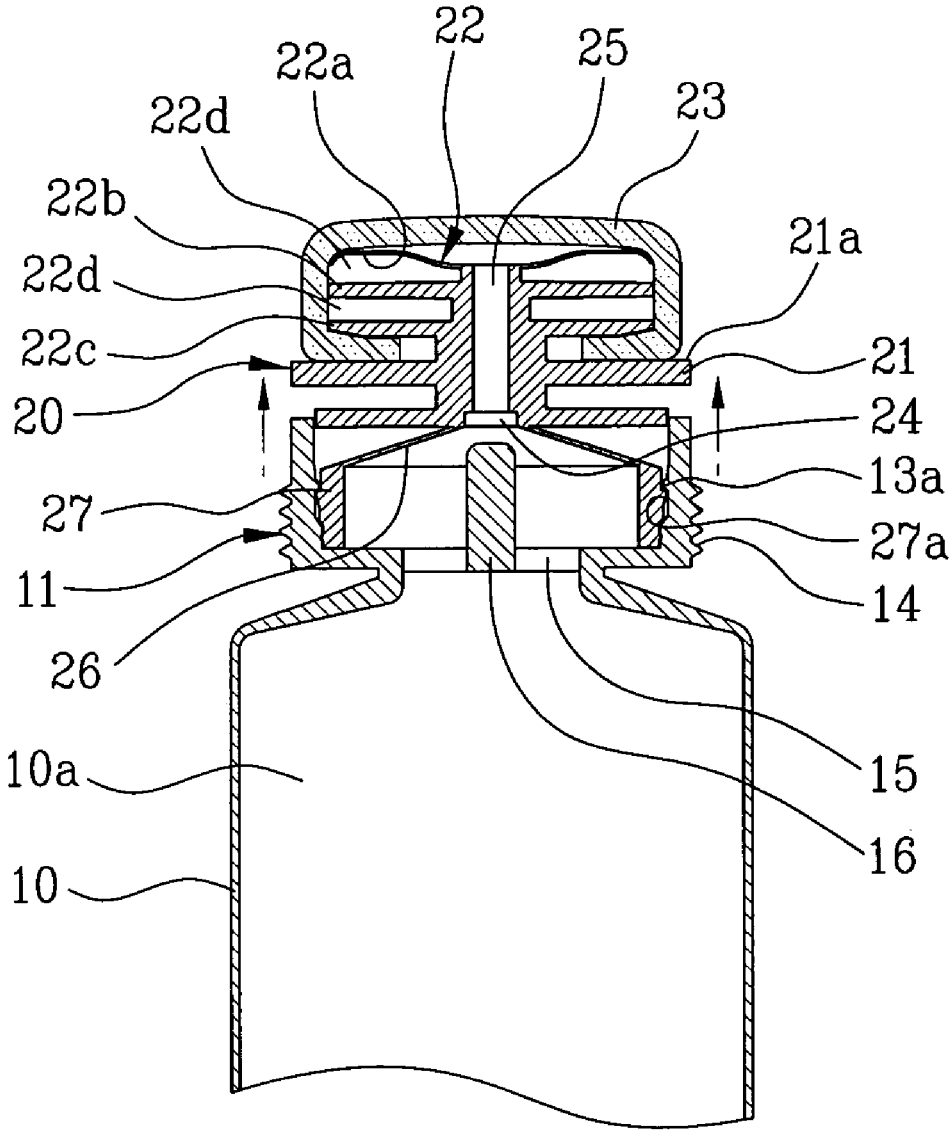
FIG. 4 is an extended sectional view illustrating a different combination structure of an intermediate member and an upper moving body according to a first embodiment of the present invention.

Meanwhile, as illustrated in FIG. 4, in the upper moving body 11, a locking protrusion wheel 13*a* is be formed to the inside, a locking step 27*a* is formed to the outside, thereby the coupling member 27 is forcibly locked into the inside of the upper moving body, thereby locking step 27*a*, formed to the outer circumference of the coupling member 27 is locked into a locking protrusion wheel 13*a* to be coupled, which makes another possible structure for the upper moving body 11.

Therefore, the effects of the present invention can be described as follows.

As illustrated in FIG. 2, a cosmetics container 1 of the present invention is normally in a closed state that a cap of an intermediate member 20 locked to the upper side of a tube-shaped container 10 is thread coupled.

At this time, an intermediate member 20 locked to an inner side of a upper moving body 11 of the tube-shaped container 10 becomes to be in a sealed state as a pressing step wheel 31 formed to the inner side of the cap 30 presses the pressing step 21*a* formed to the circumference of the pressing board 21 formed in the intermediate member 20, thereby a conical elastic part 26 formed to the lower middle side of the pressing board 21 is pressed, thereby a discharger 24 formed to the central part of the pressing board 21 is blocked by the upper side of the vertical rod 16 at the central part of the upper moving body 11 forming the tube-shaped container 10.

In the state that the discharger 24 is sealed by the upper side of the vertical rod 16 by the cap's 30 being thread coupled with the coupling member 27 formed in the intermediate member 20, if the cap 30 is opened so as to discharge cream-type cosmetics contained in a containing part 10*a*, as shown in FIG. 3, the pressing step wheel 31 formed in the inner side of the cap 30 pressing the pressing step 21*a* forming the circumference of the pressing board 21 of the intermediate member 20 drops, thereby a force being applied to the pressing boards is released, thereby the conical elastic part 26 pops up, thereby the pressing board, in which the sponge-type cap 23 is covered and fixed, rises up, thereby the discharger 24, which was closed by coming in contact with the upper side of the sponge-type cap 23, is separated from the upper side of the vertical rod 16, thereby the discharger is opened.

Likewise, as the user softly presses the tube-shaped container 10 in the opened state, cream-type cosmetics contained in the containing part of the tube-shaped container 10 is discharged to the central part of the sponge-type cap 23 through the discharge 24 and a transporting tube 25 passing through a penetrating hole 15 formed to the central part of the upper moving body 11, so that a user can apply make-up.

Meanwhile, a cup holder part 22, which is formed by the covering of the sponge-type cap 23 by being formed to the upper part of the intermediate member 20, has a space layer part 22*d*, forming an upper, middle, and lower hold plate 22*a* 22*b* 22*c*. And an upper holder plate 22*a* coming in contact with the sponge-type cap 23 is formed with a thin plate type which is flexibly bent and restored.

Likewise, the thin upper holder plate 22*a* prevents a concentrated mass to one position by making cream-type cosmetics soak through the sponge-type cap 23 evenly. And when applying make-up, the bend and the dynamic stability relieves the impact on the skin by the flexible upper holder plate 22*a*, helping a user apply make-up softly.

After finishing applying make-up like the above, the sponge-type cap 23 is thread coupled by covering the cap 30 to the upper side of the fixed intermediate member 20, thereby the pressing step wheel 31 formed to the inner side of the cap presses the pressing step 21*a*, the circumference part of the pressing board 21 formed in the intermediate member, thereby the pressing board 21 is pressed, thereby the conical elastic part 26 is compressed and lowed, thereby the discharger 24 formed in the central part of the intermediate member 20 comes in contact with the upper side of the vertical rod 16 to be sealed. In this way, it is prevented that cream-type cosmetics is discharged to the sponge-type cap 23, and when not in use, it is prevented that cream-type cosmetics is leaked.

Figure 5:
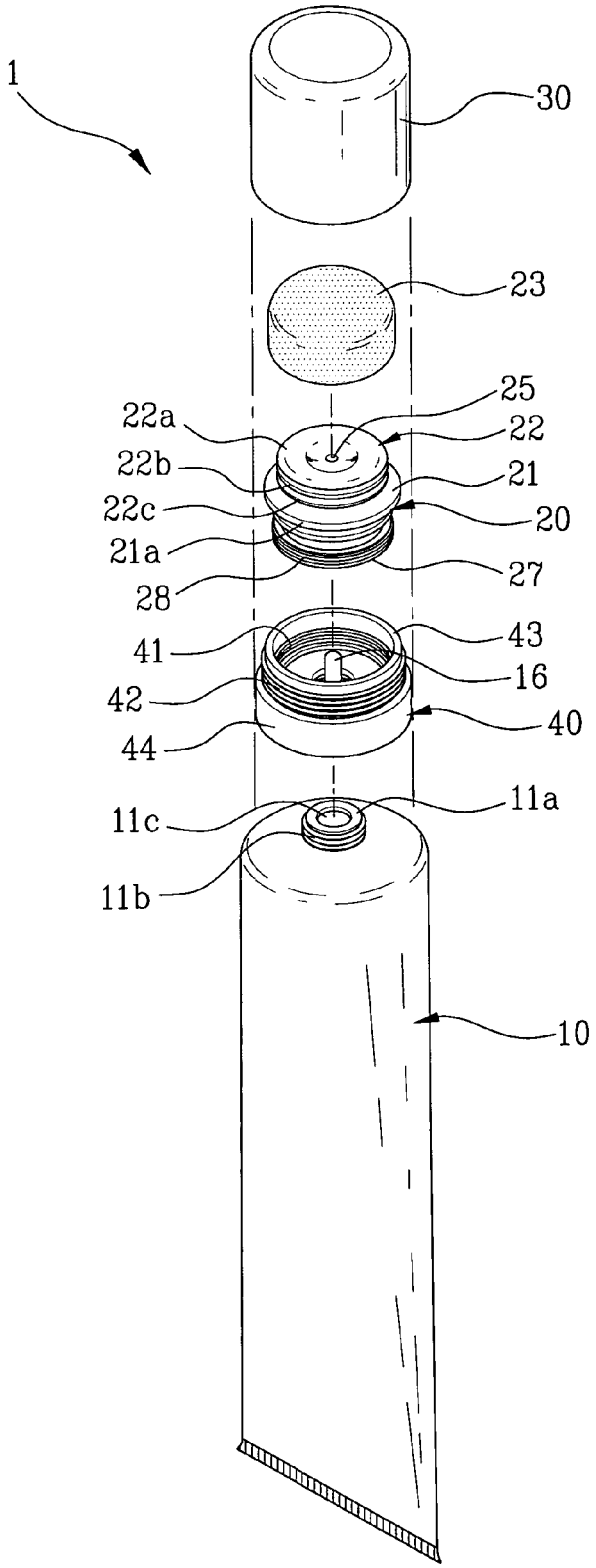
FIG. 5 is an exploded perspective view of a second embodiment of the present invention.
Figure 6:
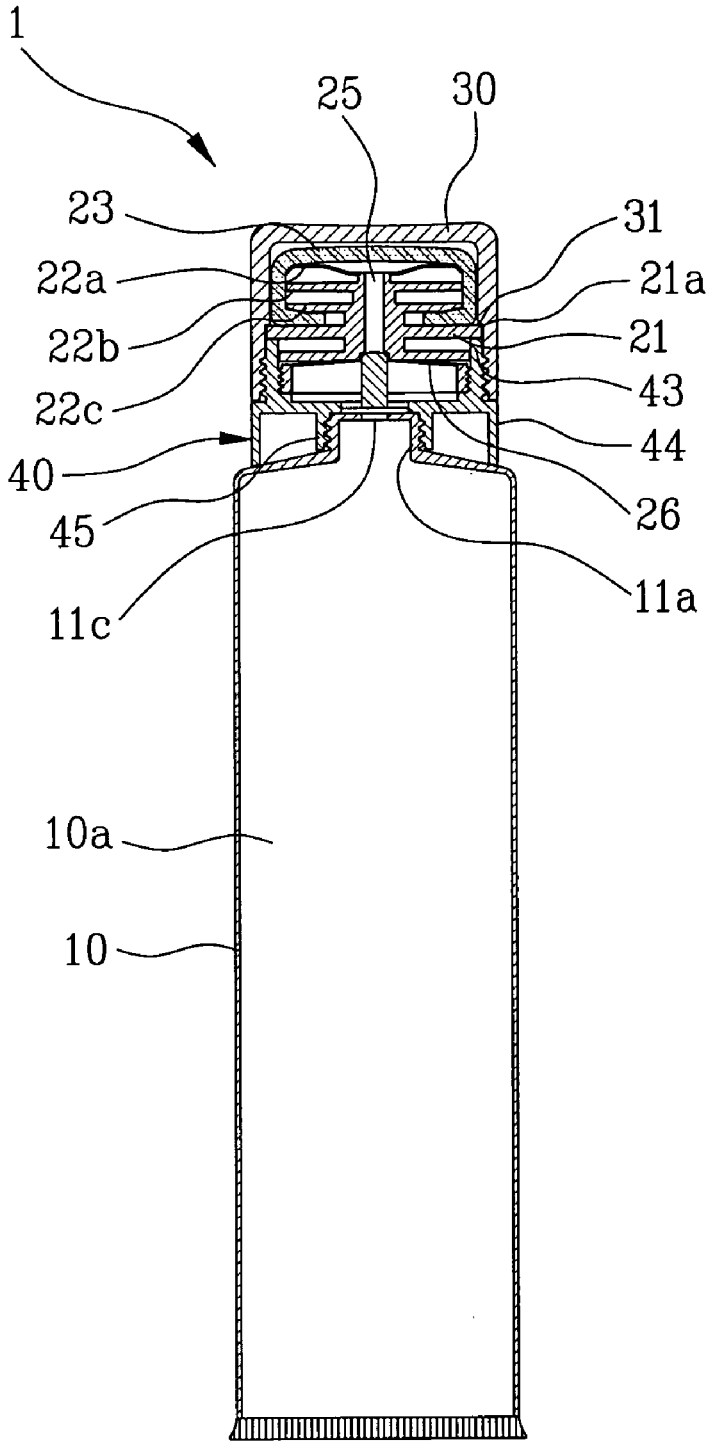
FIG. 6 is a sectional view of a second embodiment of the present invention.
Figure 7:
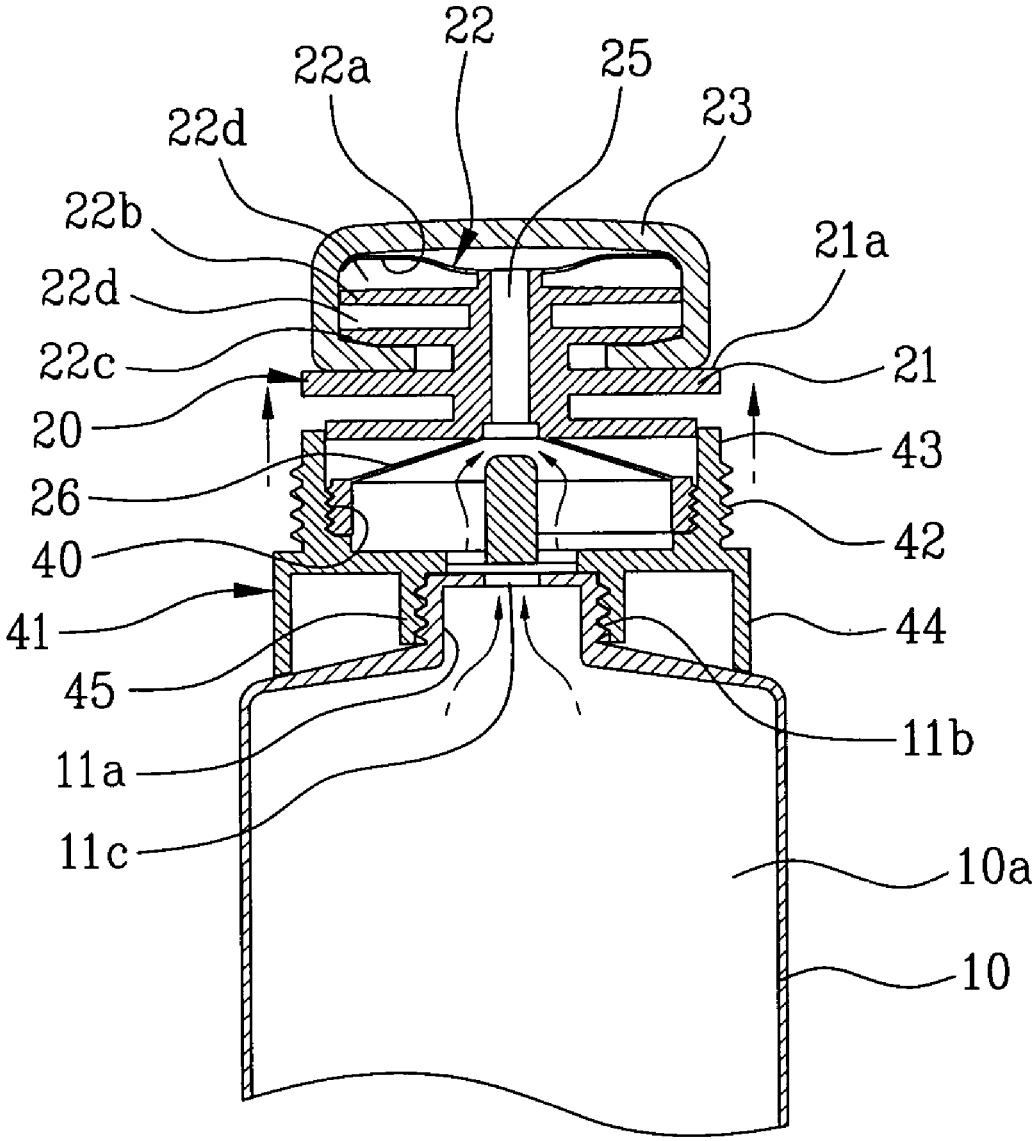
FIG. 7 is a sectional view in which a cap is opened according to a second embodiment of the present invention.

FIG. 5 is an exploded perspective view of a second embodiment of the present invention, FIG. 6 is a sectional view of a second embodiment of the present invention, and FIG. 7 is a sectional view in which a cap is opened according to a second embodiment of the present invention.

As illustrated in FIG. 5 through FIG. 7, a tube-shaped container forms a upper coupling part 11*a* having a discharger 11*c* and an upper coupling outer thread part 11*b*. Also, a upper coupling wheel of which the upper inner thread part 41 and an upper outer thread part 42 is formed, and a penetrating hole 15 is formed to the central side. Also, a vertical rod is put in the upper side, and a upper coupling moving body 40, in which an upper coupling moving body supporting wheel 44 and an upper moving body coupling part 45 are formed, is coupled.

Figure 8:
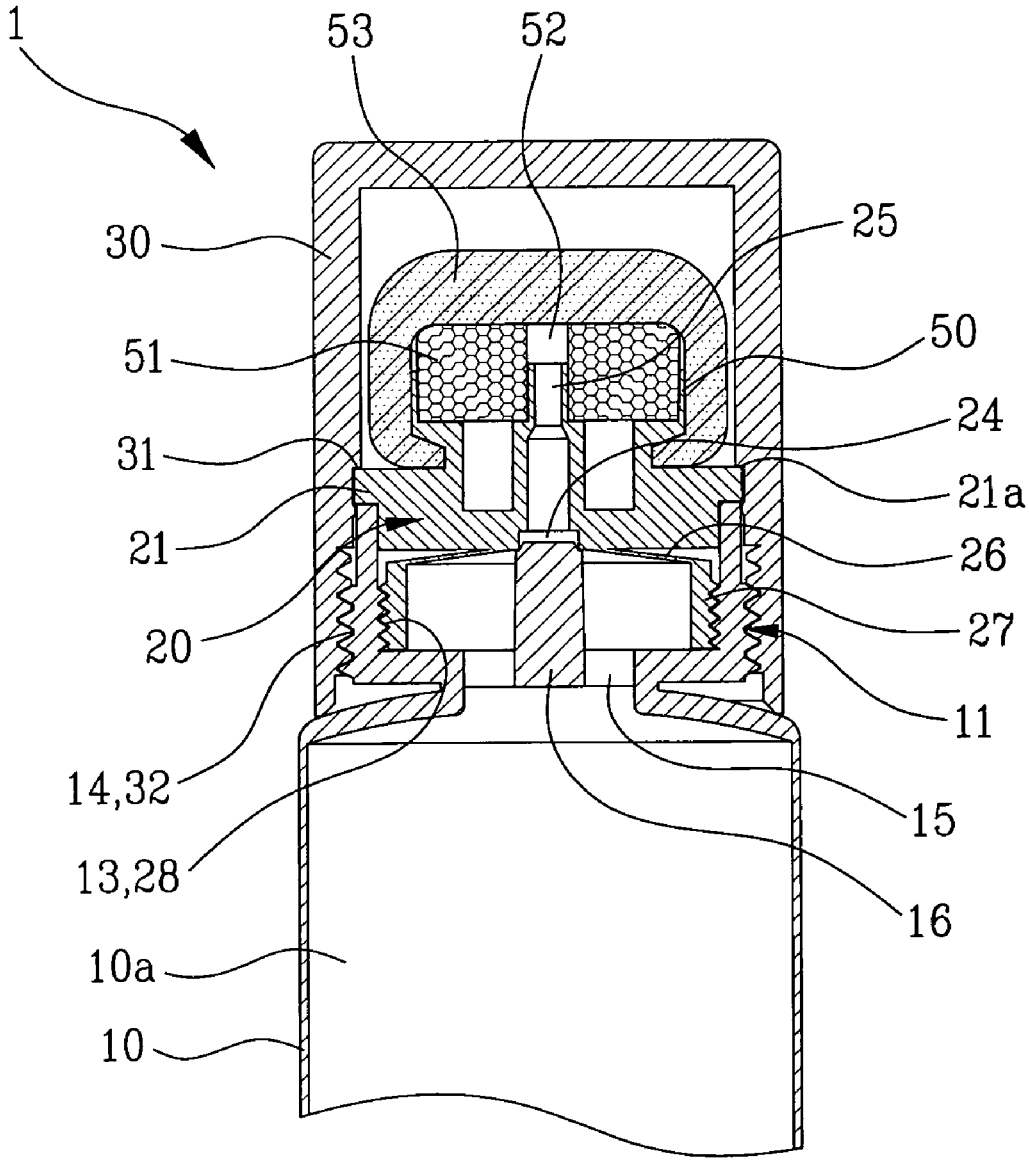
FIG. 8 is a sectional view of a third embodiment of the present invention.
Figure 9:
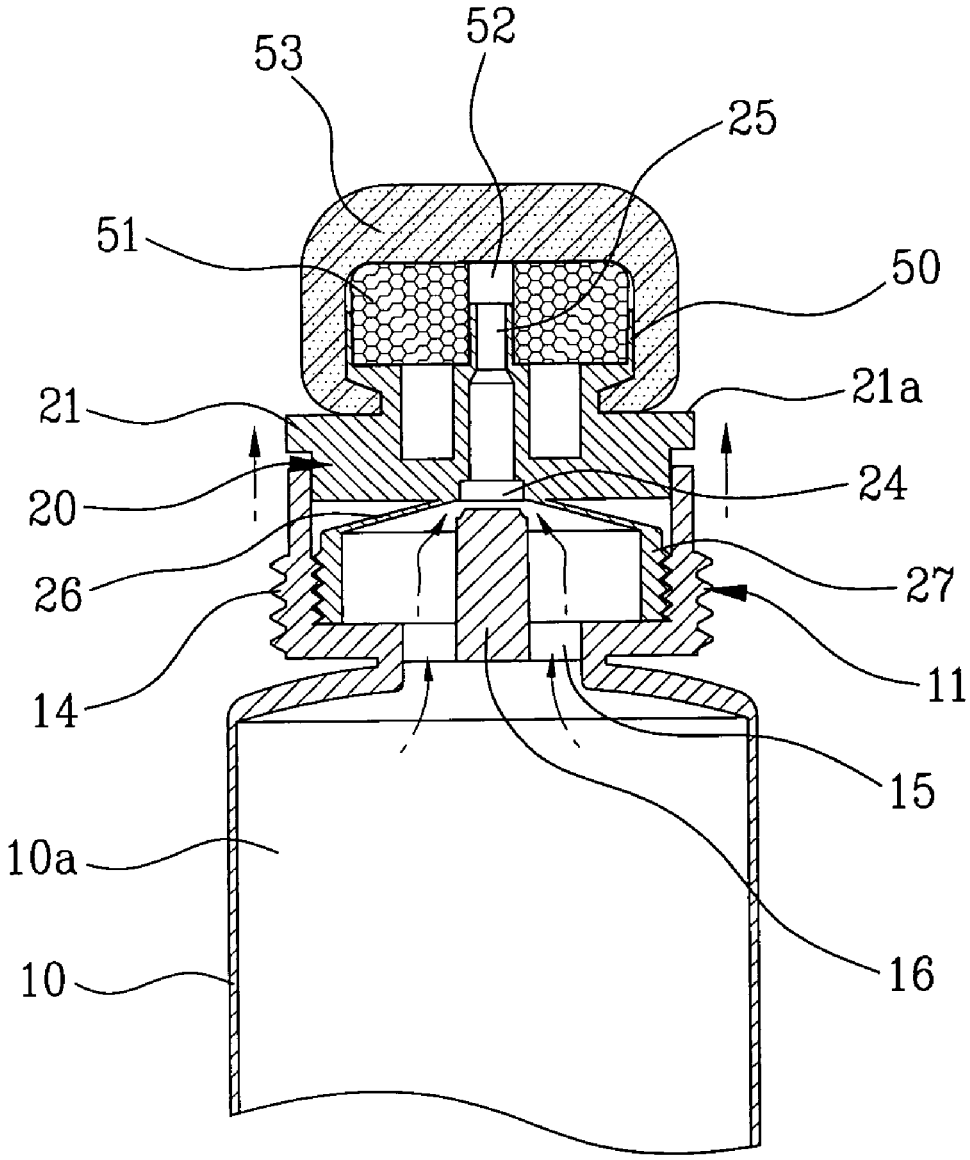
FIG. 9 is an extended sectional view illustrating a principal part of which cap is opened according to a third embodiment of the present invention.

FIG. 8 is a sectional view of a third embodiment of the present invention, and FIG. 9 is an extended sectional view illustrating a principal part of which cap is opened according to a third embodiment of the present invention.

An intermediate member 20 is covered and fixed by a cover 53 as a puff 51, in which a discharge hole 52 is formed in the upper side of the pressing board having a puff locking part 50, is locked.

As the cap 30 is opened and closed, the discharger 24 formed in the central part of the intermediate member 20 is opened and closed, thereby as the containing part of the tube-type container 10*a* is pressed, cream-type cosmetics contained in the tube-shaped container 10 is discharged to the discharge hole 24 formed to the central part of the puff, thereby the cosmetics is soaked to the inner side of the puff 51 evenly so that a user can apply make-up. So the opening/closing actions of the discharger 24 formed in the intermediate member 20, and its effects are same with those in the first embodiment.

Figure 10:
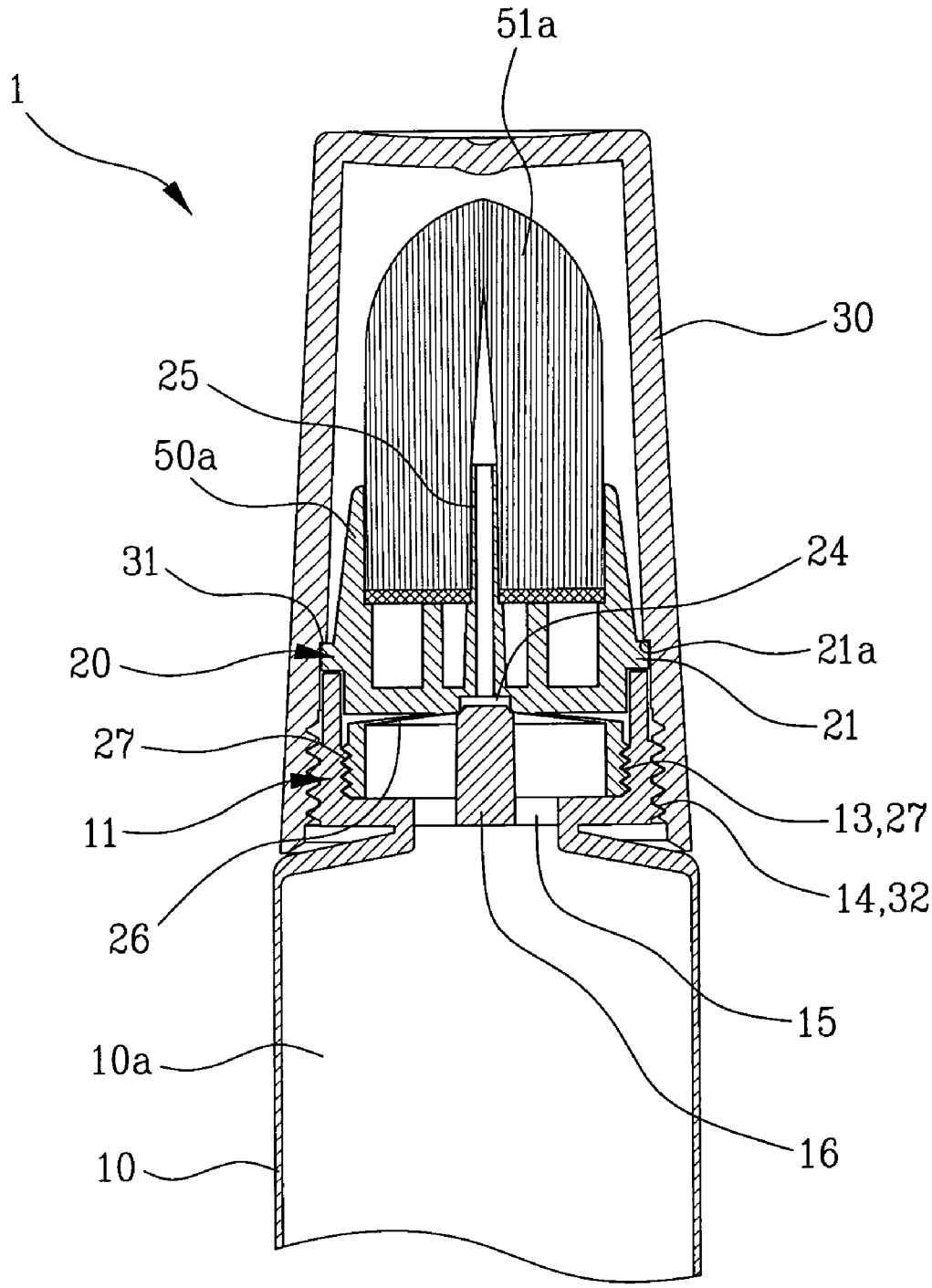
FIG. 10 is a sectional view of a fourth embodiment of the present invention.
Figure 11:
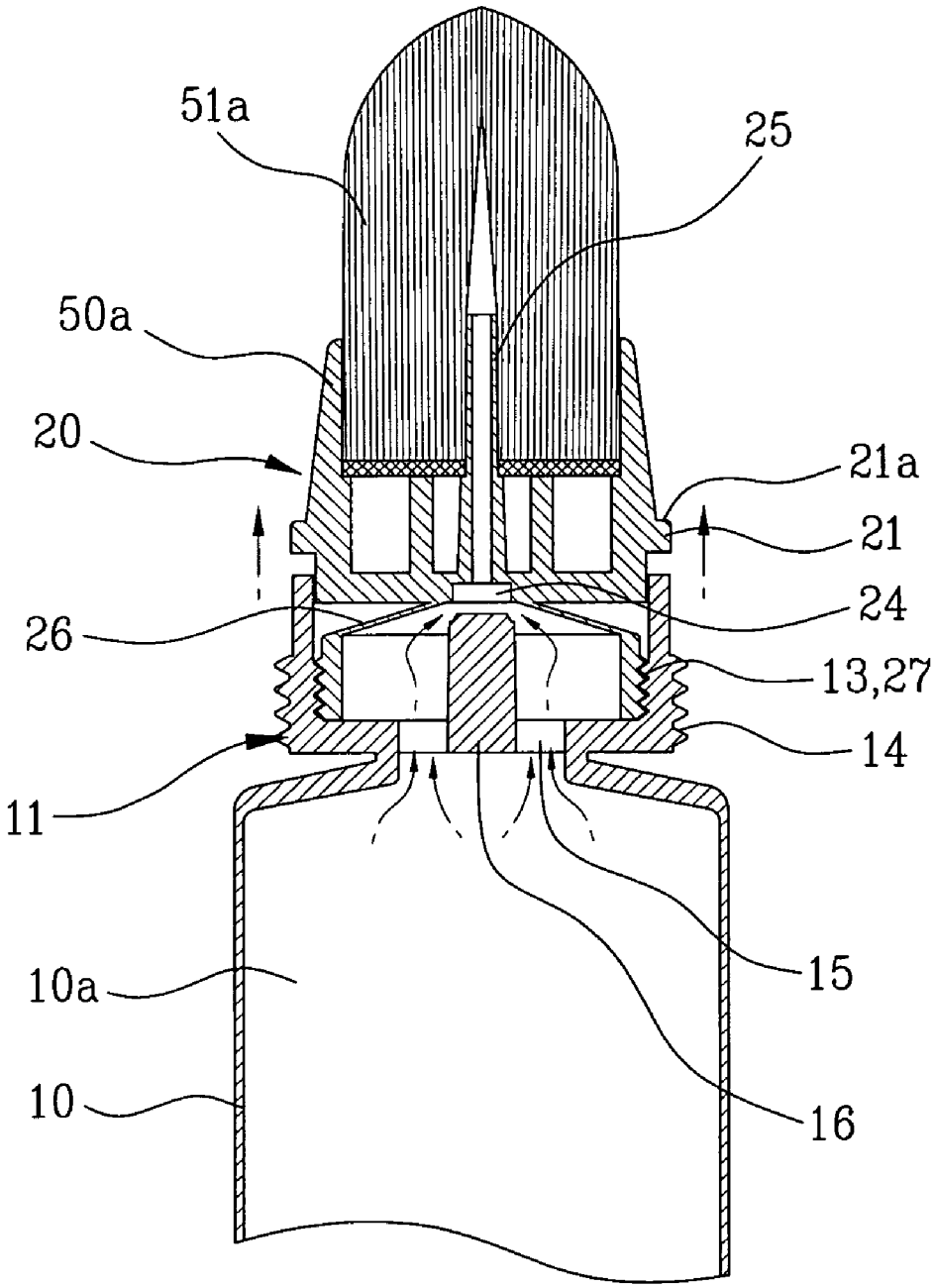
FIG. 11 is an extended sectional view illustrating a principal part of which cap is opened according to a fourth embodiment of the present invention.

FIG. 10 is a sectional view of a fourth embodiment of the present invention, and FIG. 11 is an extended sectional view illustrating a principal part of which cap is opened according to a fourth embodiment of the present invention.

Here, the intermediate member 20 forms a brush locking part 50*a* in the upper side of the pressing board 21, and a brush 51*a* is locked into the brush locking part 50*a*.

Also, as a conical elastic part 26 formed in the intermediate member 20 pops up and is compressed, the discharger is 24 is opened and closed. By pressurizing the containing part 10*a* of the tube-shaped part 10 in the state that the discharger is opened as the cap is opened, cream-type cosmetics container in the containing part 10*a* of the tube-shaped container 10 is discharged to the brush side 51*a* through the discharger 24 and the transporting tube 25 through the penetrating hole 15 of the tube-shaped container 10, thereby the cosmetics is soaked into the inner side of the brush 51*a* evenly so that a user can apply make-up. So the opening/closing actions of the discharger 24 formed in the intermediate member 20, and its effects are same with those in the first embodiment.

Figure 12:
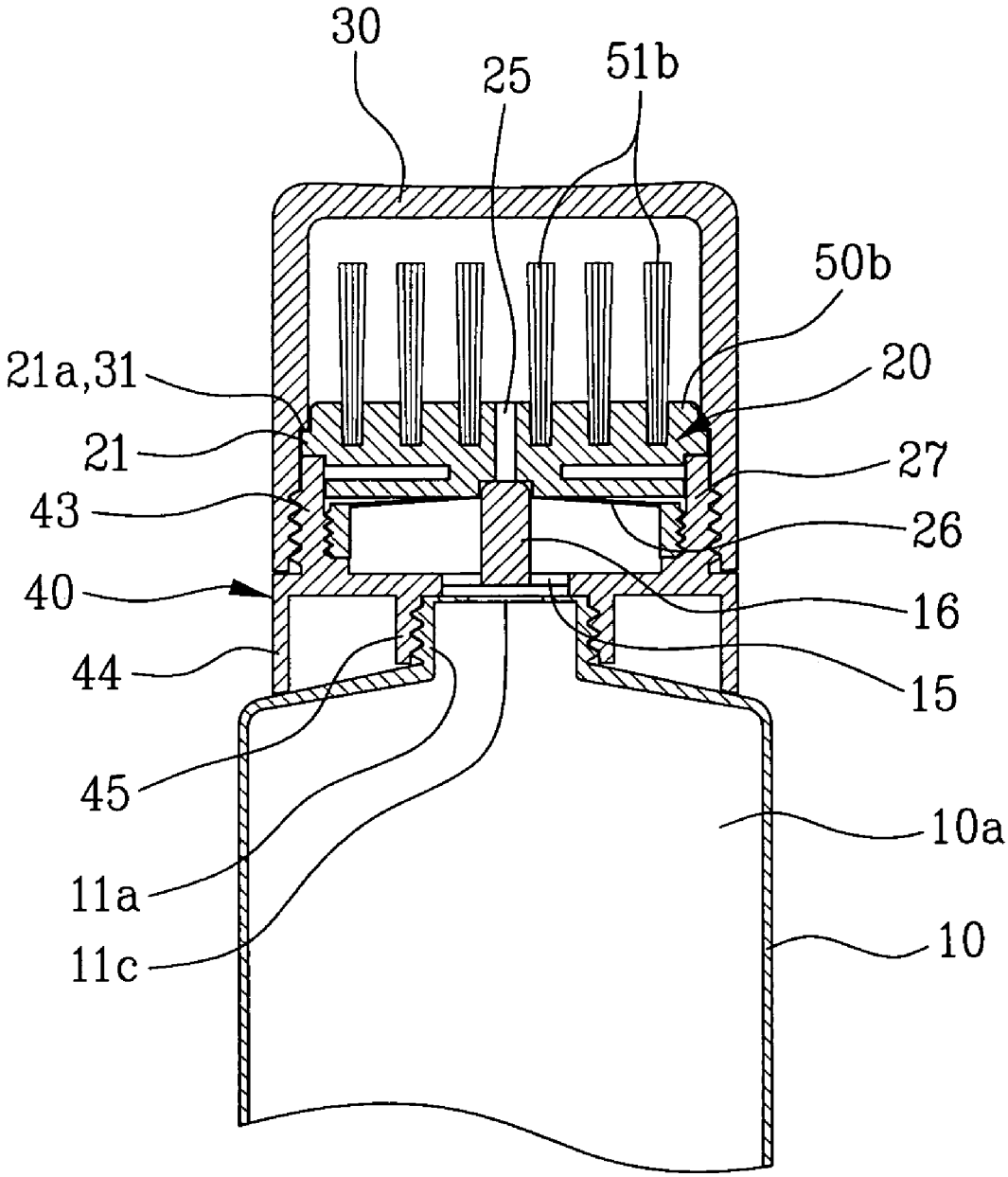
FIG. 12 is a sectional view of a fifth embodiment of the present invention.
Figure 13:
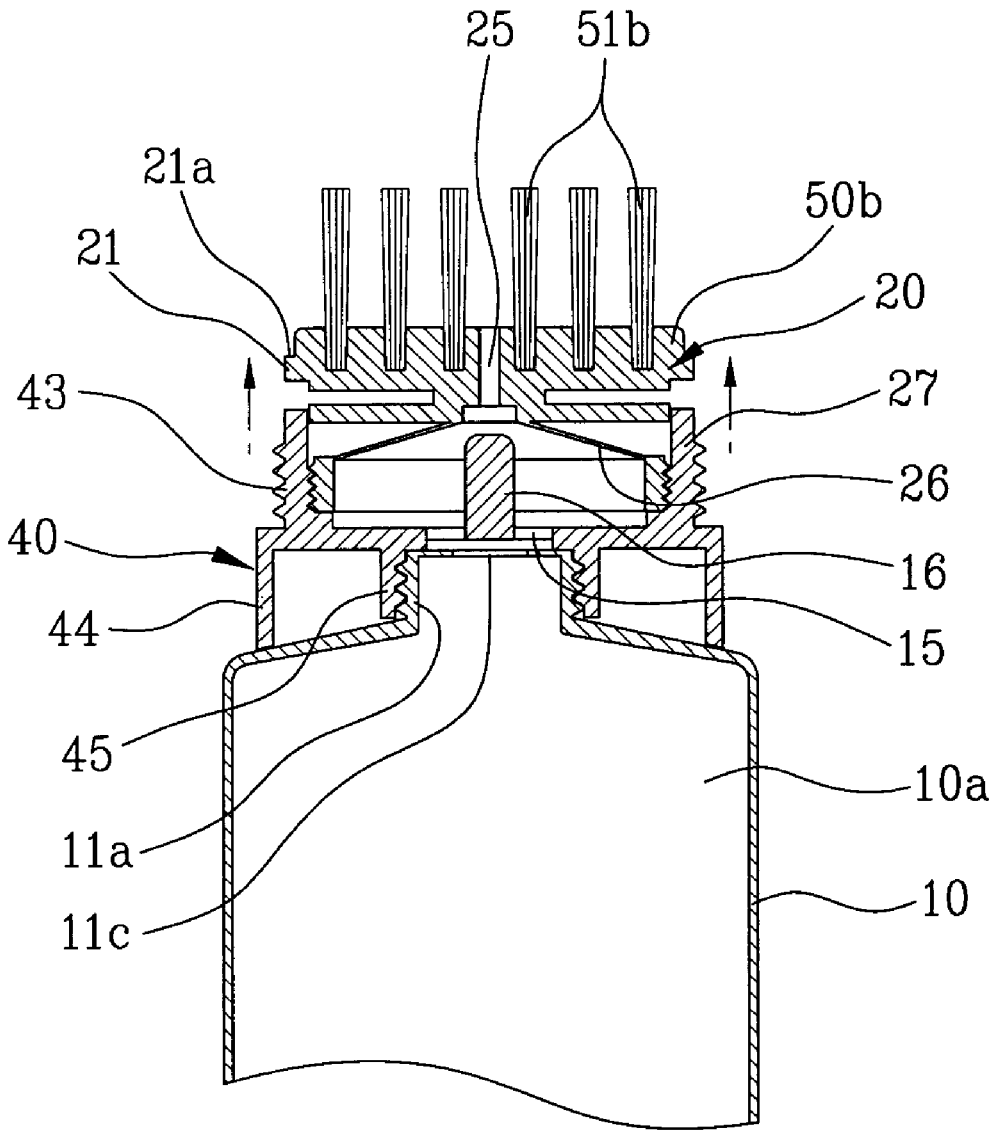
FIG. 13 is an extended sectional view illustrating a principal part of which cap is opened according to a fifth embodiment of the present invention.
Figure 14:
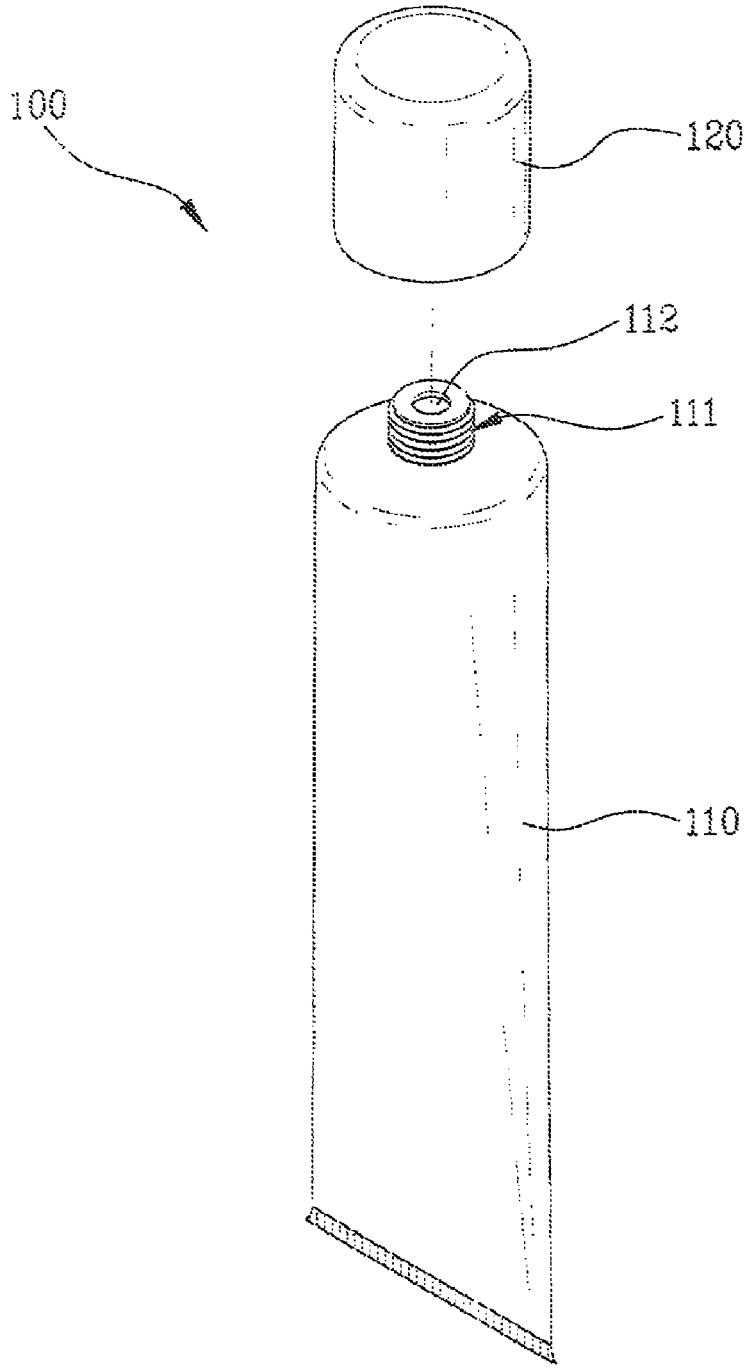
FIG. 14 PRIOR ART
FIG. 14 is an exploded perspective view illustrating a tube-shaped cosmetics container according to a conventional art.
Figure 15:
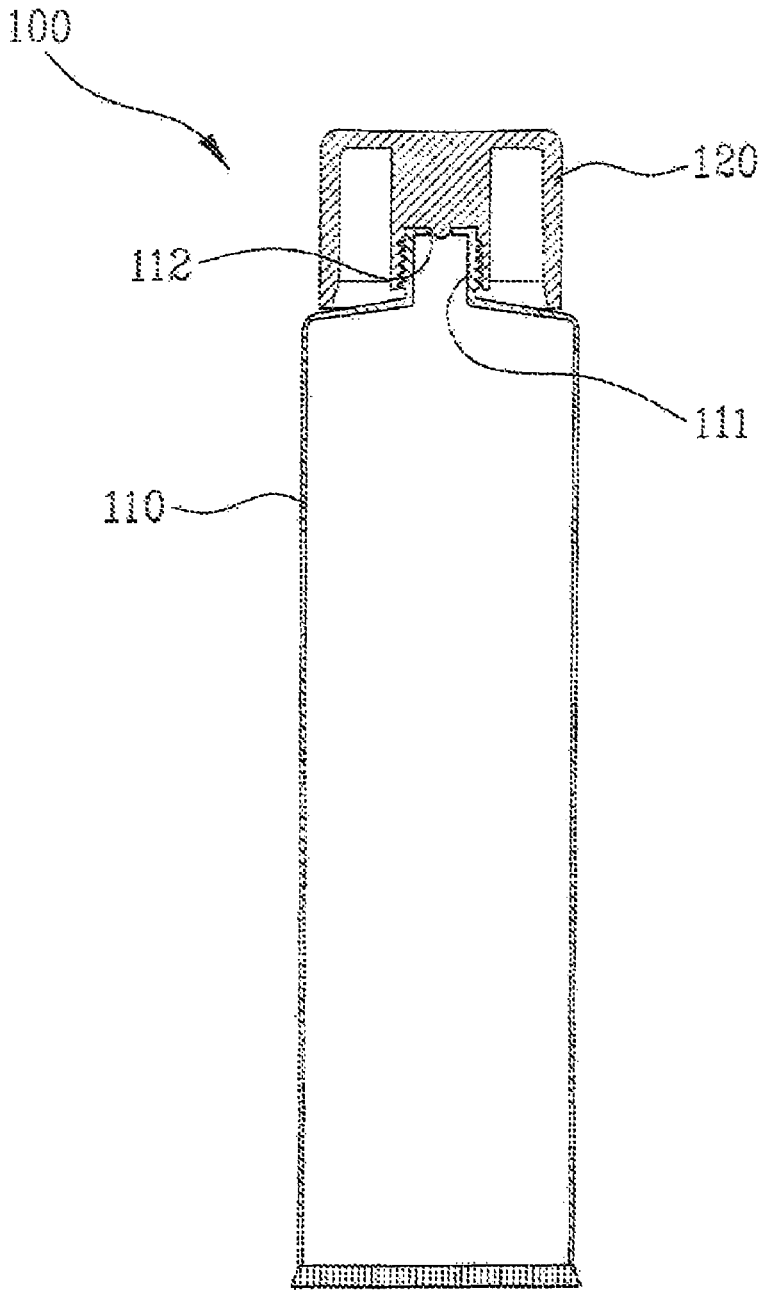
FIG. 15 PRIOR ART
FIG. 15 is sectional view of a tube-shaped cosmetics container according to a conventional art.

FIG. 12 is a sectional view of a fifth embodiment of the present invention, and FIG. 13 is an extended sectional view illustrating a principal part of which cap is opened according to a fifth embodiment of the present invention.

The intermediate member 20 forms a brush locking fixing part 50*b* in the upper side of the pressing board 21, several brushes 51*b* are locked and fixed in the locking fixing part 50*b*.

The cosmetics container 1, in which several brushes 51*b* are locked and fixed, can be used for dyeing hair. In this $5^{th}$ embodiment of the present invention, a conical elastic part 26 formed in the intermediate member 20 pops up and is compressed as the cap 30 is opened and closed, thereby the containing part 10*a* of the tube-shaped container 10*a* is pressurized in the state that the discharger 24 is opened and closed, thereby for example, a hairdye as an example of cream-type cosmetics passes through the penetrating hole 15 of the tube-shaped container 10, then is discharged to the central side of the several brushes 51*b* through the discharger 24 and the transporting tube 25, thereby the cosmetics is soaked into the inner side of the brushes 51*b* so that a user can apply make-up including dyeing. Here, the opening/closing actions of the discharger 24 formed in the intermediate member 20, and its effects are same with those in the first embodiment, so they are not explained in detail here.

Therefore, when the cap is opened, the discharger is opened, and when closed, the discharger is sealed, which makes the discharge of cream-type cosmetics easy. And when not in use, an intermediate member is pressed by being thread coupled, thereby the discharger is naturally sealed so that the discharge of cream-type cosmetics contained in the tube-shaped container is prevented, by which cream-type cosmetics is less wasted, and a clean state is always kept by preventing contamination of surrounding areas of the cosmetic container 1.

What is claimed is:

1. A tube-shaped cosmetics container for discharging cream-type cosmetics, the container comprising:

a tube-shaped container for containing cosmetics, the tube-shaped container including:

an upper moving body having a penetrating hole formed therein, the upper moving body having an inner coupling portion and an outer threaded portion; and a vertical rod located in the penetrating hole and integrally formed with the upper moving body;

an intermediate member coupled to the upper moving body, the intermediate member being configured to transport and discharge cosmetics, the intermediate member including:

a body having a pressing board;

a transporting tube having a discharge hole to discharge cosmetics, the transporting tube being formed in the body;

a conical elastic part located at a lower portion of the transporting tube; and a coupling member having an outer coupling portion, the outer coupling portion being coupled to the inner coupling portion of the upper moving part; and a cap configured to be coupled to the upper moving body, the cap including:

an inner threaded part coupled to the outer threaded part of the upper moving body; and a pressing step configured to press the pressing board of the intermediate member, wherein when the pressing step of the cap presses the pressing board of the intermediate member, the vertical rod closes the transporting tube and when the pressing step does not press the pressing board, the conical elastic part moves the intermediate member away from the rod to open the transporting tube.

2. The container of claim 1, further comprising:

a sponge-type cap located between the intermediate member and the cap, wherein the intermediate member includes a cap holding part, the sponge-type cap being located between the cap holding part and the cap.

3. The container of claim 1, wherein the inner coupling portion includes a locking protrusion wheel, and the outer coupling portion includes a locking step wheel formed at an outer circumference of the coupling member, the locking step wheel being fixed to the locking protrusion wheel.

4. The container of claim 1, further comprising a puff to cover the discharge hole of the intermediate part, the intermediate member including a puff locking part to which the puff is fixed.

5. The container of claim 1, further comprising a brush to dispense cosmetics, the intermediate member including a brush locking part to which the brush is fixed.

6. The container of claim 1, further comprising a plurality of brushes to dispense cosmetics, the intermediate member including a brush locking part to which the plurality of brushes are fixed.

7. The container of claim 1, wherein the intermediate member is a single one piece member.

8. The container of claim 1, further comprising a brush to dispense cosmetics, the transport tube extending into the brush.

9. A cosmetics container for discharging cosmetics, the container comprising:

a container body configured to hold cosmetics, the container body including:

a penetrating hole; and an intermediate member coupled to the container body, the intermediate member including:

a body having a pressing board;

a transporting tube having a discharge hole to discharge cosmetics, the transporting tube being formed in the body, the transporting tube being in fluid communication with the penetrating hole; and an elastic part located at a lower portion of the transporting tube;

a rod provided between the penetrating hole and the transporting tube, the rod extending upwards toward the bottom of the transporting tube; and a cap configured to be coupled to the container body, the cap including a pressing step configured to press the pressing board of the intermediate member when coupled to the container body, wherein when the pressing step presses the pressing board, the rod closes the transporting tube and when the pressing step does not press the pressing board, the elastic part moves the intermediate member away from the rod to open the transporting tube, wherein the container body includes an upper moving body having an inner coupling portion and an outer threaded portion, the penetrating hole being located in the upper moving body, and wherein the intermediate member includes a coupling member having an outer coupling portion, the outer coupling member is coupled to the inner coupling portion, and the elastic part is located between the coupling member and the discharge hole.

10. The container of claim 9, wherein the cap includes an inner threaded portion, the inner threaded portion being coupled to the outer threaded portion of the upper moving body.

11. The container of claim 9, wherein the inner coupling portion is threaded and the outer coupling portion is threaded.

12. The container of claim 9, further comprising:

a sponge-type cap located between the intermediate member and the cap, wherein the intermediate member includes a cap holding part, the sponge-type cap being located between the cap holding part and the cap.

13. The container of claim 9, further comprising a puff to cover the discharge hole of the intermediate part, the intermediate member including a puff locking part to which the puff is fixed.

14. The container of claim 9, further comprising a brush to dispense cosmetics, the intermediate member including a brush locking part to which the brush is fixed.

15. The container of claim 9, further comprising a plurality of brushes to dispense cosmetics, the intermediate member including a brush locking part to which the plurality of brushes are fixed.

16. The container of claim 9, wherein the intermediate member is a single one piece member.

17. The container of claim 9, wherein the pressing step is a shoulder formed on an inner surface of the cap.

18. The container of claim 9, wherein the rod is solid to seal the transporting tube.

* * * * *